US010547124B2

(12) United States Patent
Robicheau et al.

(10) Patent No.: US 10,547,124 B2
(45) Date of Patent: Jan. 28, 2020

(54) COMPRESSION CONNECTOR

(71) Applicant: Hubbell Incorporated, Shelton, CT (US)

(72) Inventors: Richard E Robicheau, Litchfield, NH (US); Glen Harrison Ruggiero, Manchester, NH (US); Benjamin Joseph Michaud, Hooksett, NH (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 16/105,712

(22) Filed: Aug. 20, 2018

(65) Prior Publication Data

US 2019/0058265 A1 Feb. 21, 2019

Related U.S. Application Data

(60) Provisional application No. 62/547,862, filed on Aug. 20, 2017.

(51) Int. Cl.

| | |
|---|---|
| ***H01R 4/18*** | (2006.01) |
| ***H01R 4/2495*** | (2018.01) |
| ***H01R 11/05*** | (2006.01) |
| ***H01R 11/09*** | (2006.01) |
| ***H01R 11/07*** | (2006.01) |
| ***H01R 4/2407*** | (2018.01) |
| ***H01R 9/03*** | (2006.01) |

(52) U.S. Cl.

CPC ..... *H01R 4/186* (2013.01); *H01R 4/184* (2013.01); *H01R 4/2407* (2018.01); *H01R 4/2495* (2013.01); *H01R 9/031* (2013.01); *H01R 11/07* (2013.01); *H01R 11/09* (2013.01); *H01R 11/05* (2013.01)

(58) Field of Classification Search

CPC ..... H01R 4/186; H01R 4/18; H01R 4/184; H01R 4/185; H01R 4/183; H01R 4/2407; H01R 4/2404; H01R 4/2495

See application file for complete search history.

(56) References Cited

U.S. PATENT DOCUMENTS

| | | | | |
|---|---|---|---|---|
| 2,938,069 A | | 5/1960 | Toedtman et al. | |
| 2,956,108 A | | 10/1960 | Brenner | |
| 3,322,888 A | | 5/1967 | Zemels | |
| 3,354,517 A | | 11/1967 | Levinsky | |
| 3,746,777 A | | 7/1973 | Peek | |
| 3,781,459 A | | 12/1973 | Peek | |
| 4,350,843 A | * | 9/1982 | Campbell | H01R 4/186 174/84 C |
| 4,427,253 A | * | 1/1984 | Smith | H01R 4/2408 439/413 |
| 5,036,164 A | | 7/1991 | Schrader et al. | |
| 5,103,068 A | | 4/1992 | Schrader | |

(Continued)

OTHER PUBLICATIONS

International Search Report and Written Opinion mailed in PCT/US18/47109 dated Nov. 21, 2018.

(Continued)

*Primary Examiner* — Hoa C Nguyen
*Assistant Examiner* — Amol H Patel
(74) *Attorney, Agent, or Firm* — Wissing Miller LLP

(57) ABSTRACT

The present disclosure provides embodiments of compression-type electrical connectors used to connect one or more branch wires or conductors to one or more run wires or conductors.

27 Claims, 11 Drawing Sheets

(56) References Cited

U.S. PATENT DOCUMENTS

| | | | | |
|---|---|---|---|---|
| 5,162,615 | A | 11/1992 | Schrader et al. | |
| 5,200,576 | A | 4/1993 | Schrader et al. | |
| 5,396,033 | A | 3/1995 | Piriz et al. | |
| 5,552,564 | A | 9/1996 | Schrader et al. | |
| 5,635,676 | A | 6/1997 | Piriz | |
| 5,898,131 | A | 4/1999 | Chadbourne et al. | |
| 6,261,137 | B1 | 7/2001 | Wilcox | |
| 6,525,270 | B1 | 2/2003 | Connor et al. | |
| 6,538,204 | B2 | 3/2003 | Connor | |
| 7,511,224 | B1 | 3/2009 | Kossak | |
| 2003/0010524 | A1* | 1/2003 | Connor | H01R 4/186 174/84 C |
| 2015/0229037 | A1* | 8/2015 | Uchida | H01R 43/01 439/877 |

OTHER PUBLICATIONS

YH292C Data Sheet Burndy Electrical (FCI USA Inc.), Dec. 28, 1990, Rev #9.

* cited by examiner

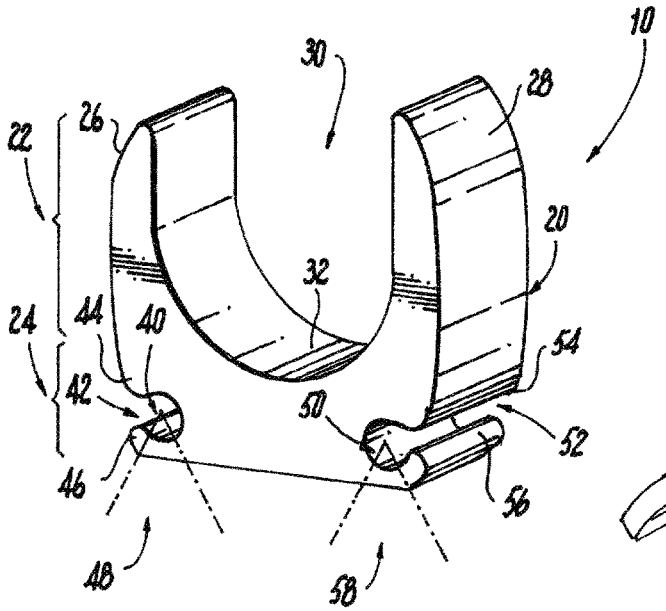
Fig. 1
Fig. 2
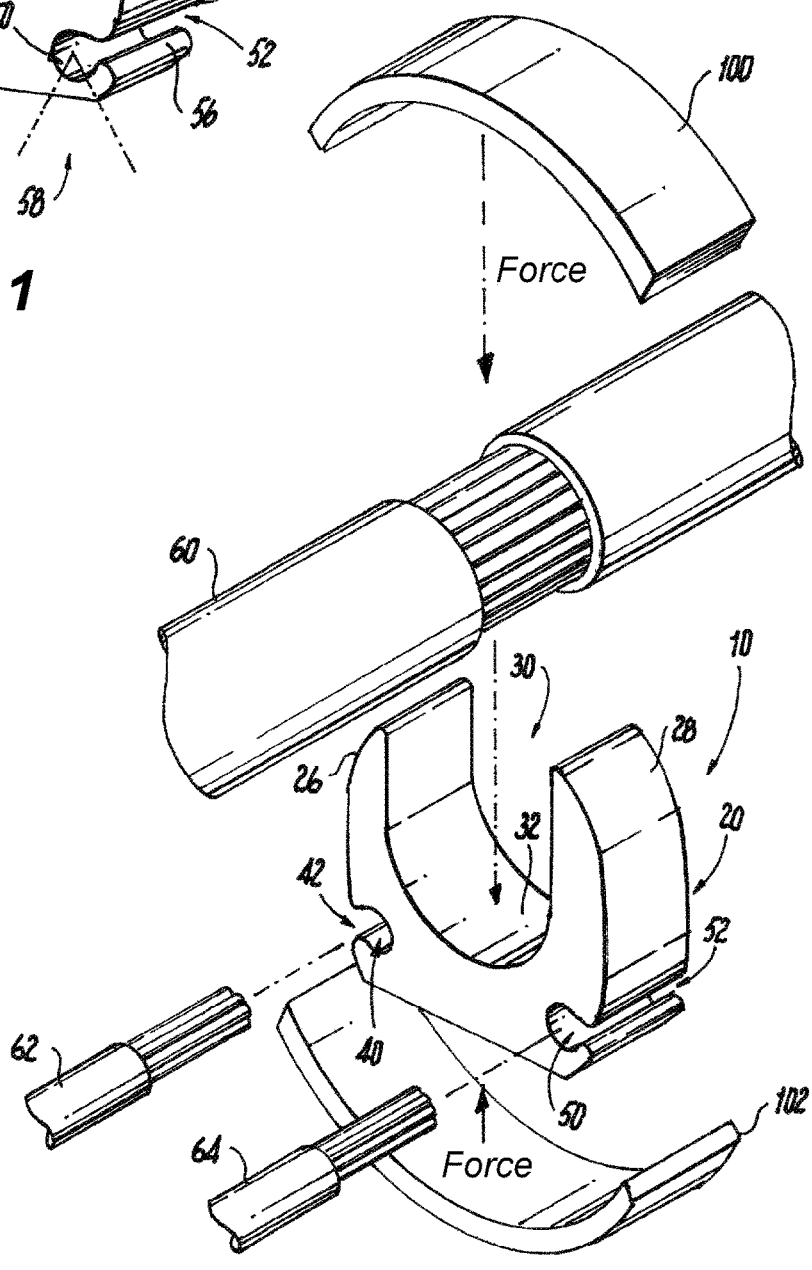

Fig. 12
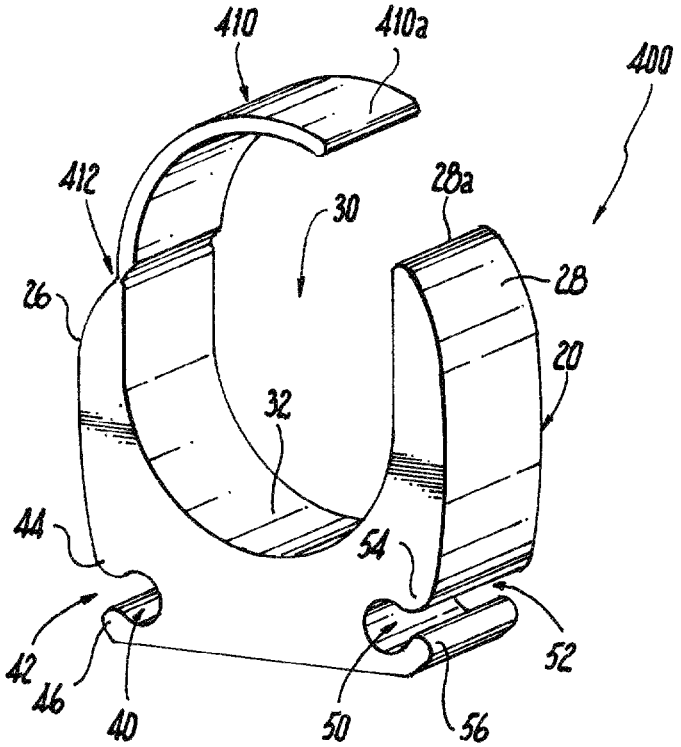
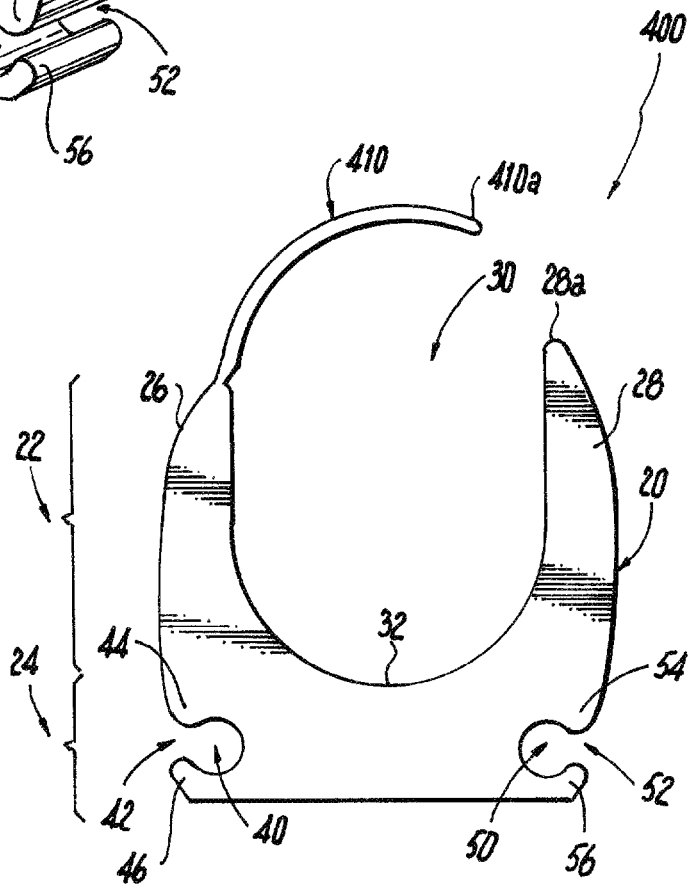
Fig. 13

Fig. 28
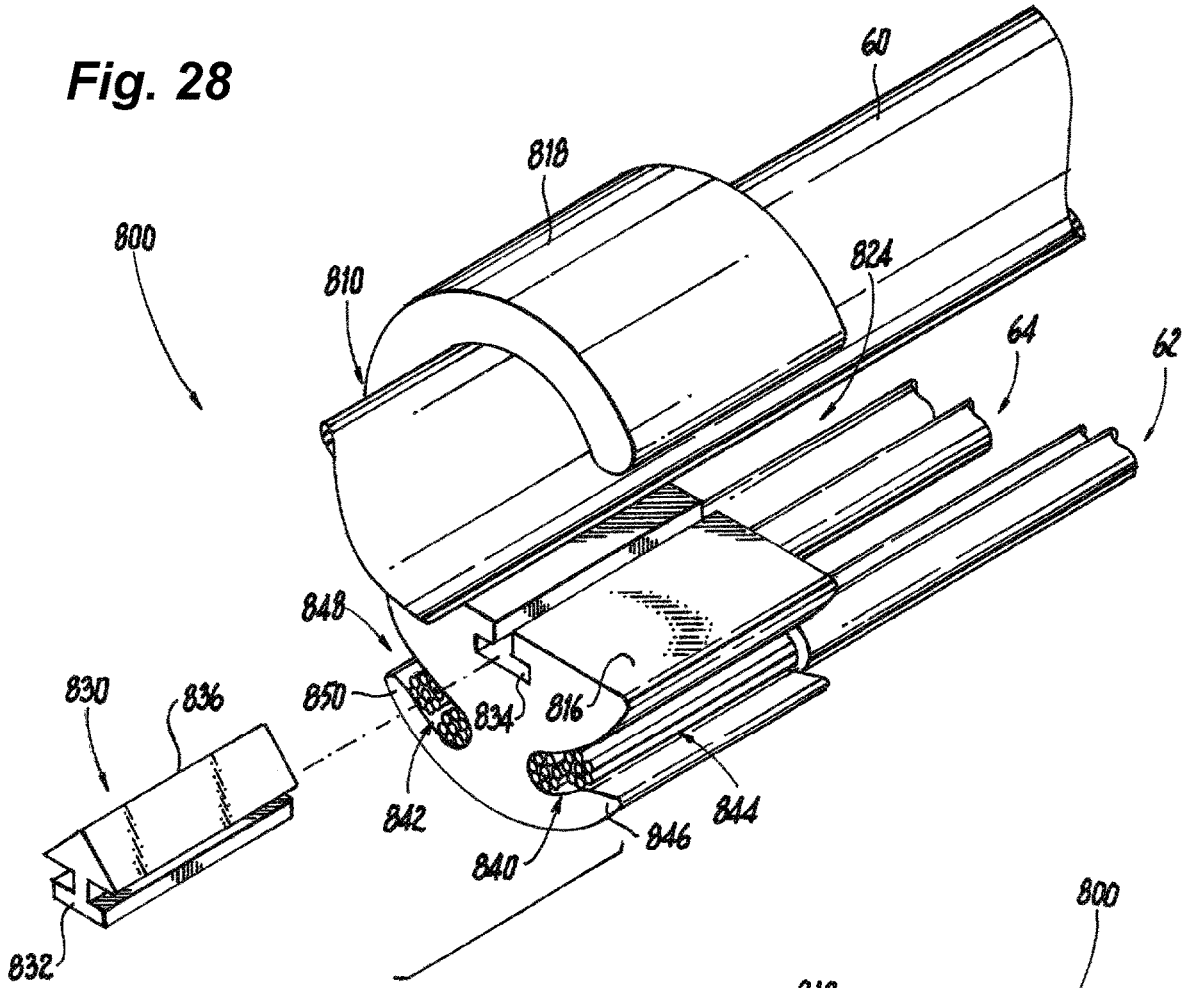
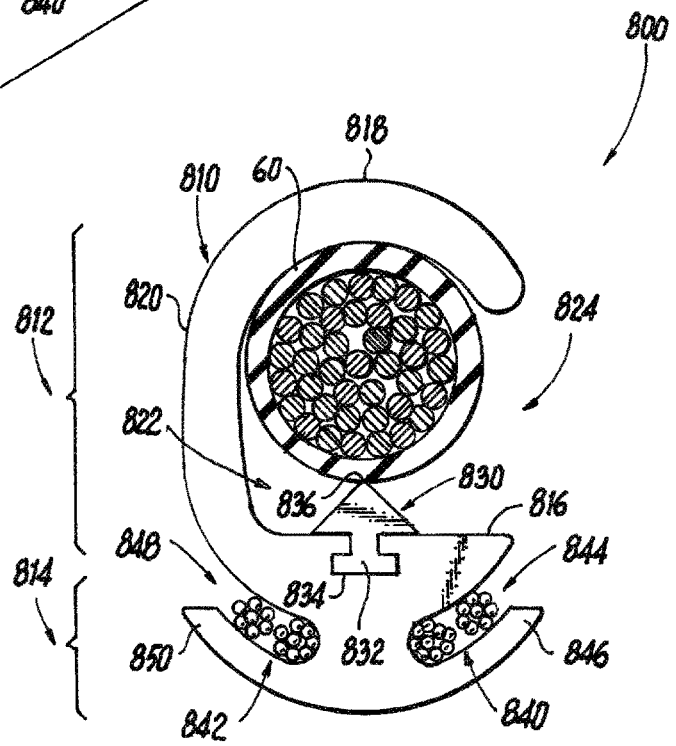
Fig. 29

COMPRESSION CONNECTOR

CROSS REFERENCE TO RELATED APPLICATIONS

The present disclosure is based on and claims benefit from U.S. Provisional Patent Application Ser. No. 62/547,862, filed Aug. 20, 2017 entitled "Compression Connector" the entire contents of which are incorporated herein by reference.

BACKGROUND

Field

The present disclosure relates generally to electrical compression connectors for connecting one or more solid or stranded wires or conductors of one size to one or more wires or conductors of another size. More specifically, the present disclosure relates to compression-type electrical connectors for connecting one or more branch wires or conductors to one or more run wires or conductors.

Description of the Related Art

Tap connectors have been used to establish an electrical connection between a continuous main power conductor to a branch conductor. Similarly, tap connectors have been used to establish an electrical connection between a distribution power conductor (also referred to as a run) and one or more main power conductors. Compression type tap connectors are typically adapted to receive a branch or tap conductor, to engage a continuous run conductor, and to be compressed by means of a crimping tool to achieve the desired connection.

However, with prior tap connectors either prior to or during the crimping process, one or more of the wires, conductors or wire strands "pop out" of their respective slots in the connector before the crimping tool can be applied and the connector compressed.

SUMMARY

The present disclosure provides embodiments of compression-type electrical connectors used to connect one or more branch wires or conductors to one or more run wires or conductors. In an exemplary embodiment, the compression connector includes a connector body of compressible material adapted to be inserted into a crimping tool having two opposed curved die surfaces for the compression of the connector. The connector body has a run conductor portion and a branch conductor portion. The run conductor portion includes a pair of parallel side walls joined by a rounded bottom wall and a run conductor opening between the pair of side walls and the bottom wall. The branch conductor portion includes at least one branch conductor opening having a lead-in with a rib on each side of the lead-in, and a hinge portion between the branch conductor opening and the connector body such that when force is applied by the crimping tool to the connector body, the hinge portion of the connector body will compress first to secure the branch conductor to the connector body, and when additional force is applied by the crimping tool to the connector body the connector body is compressed around a run conductor positioned in the run conductor opening. The compression connector may also include a conductor retainer that is movably attached to one of the pair of side walls of the run conductor portion by, for example, a living hinge. The compression connector may also include at least one insulation piercing member extending from at least one of the pair of side walls or the bottom wall into the run conductor opening. The insulation piercing members are provided to pierce or cut through insulation surrounding electrical wires in the run conductor or the branch conductor. The insulation piercing members may be removably attached to at least one of the pair of side walls or the bottom wall of the connector body. The compression connector may also include an adapter removably attached to the connector body within the conductor opening. The adapter has an inner arcuate surface that may have one or more insulation piercing members extending from the arcuate surface.

In another exemplary embodiment, the compression connector includes a connector body of compressible material adapted to be inserted into a crimping tool having two opposed curved die surfaces for the compression of the connector body. The connector body has a run conductor portion and a branch conductor portion. The run conductor portion includes a pair of side walls joined by a bottom wall, and a run conductor opening between the pair of side walls and the bottom wall. The branch conductor portion includes at least one branch conductor opening. In this exemplary embodiment, the compression connector may also include at least one insulation piercing member extending from at least one of the pair of side walls or the bottom wall into the run conductor opening. The at least one insulation piercing member may be removably attached to at least one of the pair of side walls or the bottom wall. Preferably, the at least one insulation piercing member is removably attached to the bottom wall. The compression connector according to this exemplary embodiment may also include a conductor retainer movably attached to one of the pair of side walls of the run conductor portion by, for example, living hinge. The compression connector according to this exemplary embodiment may also include an adapter removably attached to the connector body within the conductor opening. The adapter has an inner arcuate surface, and may include at least one insulation piercing member extending from the arcuate surface of the adapter.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein:

FIG. 1 is a perspective view of an exemplary embodiment of a compression connector according to the present disclosure;

FIG. 2 is an exploded perspective view of the compression connector of FIG. 1 positioned between a pair of dies of a hydraulic powered crimping tool with a run conductor and two branch conductors for crimping;

FIG. 12 is a perspective view of another exemplary embodiment of a compression connector according to the present disclosure, illustrating a movable conductor retainer coupled to a body of the compression connector;

FIG. 13 is a side elevation view of the compression connector of FIG. 12;

FIG. 28 is a perspective view of another exemplary embodiment of compression connector according to the present disclosure, illustrating a connector body with an opening for receiving a conductor and a removable insulation piercing member extending from an interior wall of the body into the opening; and FIG. 29 is a side elevation view of the compression connector of FIG. 28.

DETAILED DESCRIPTION

Figure 3:
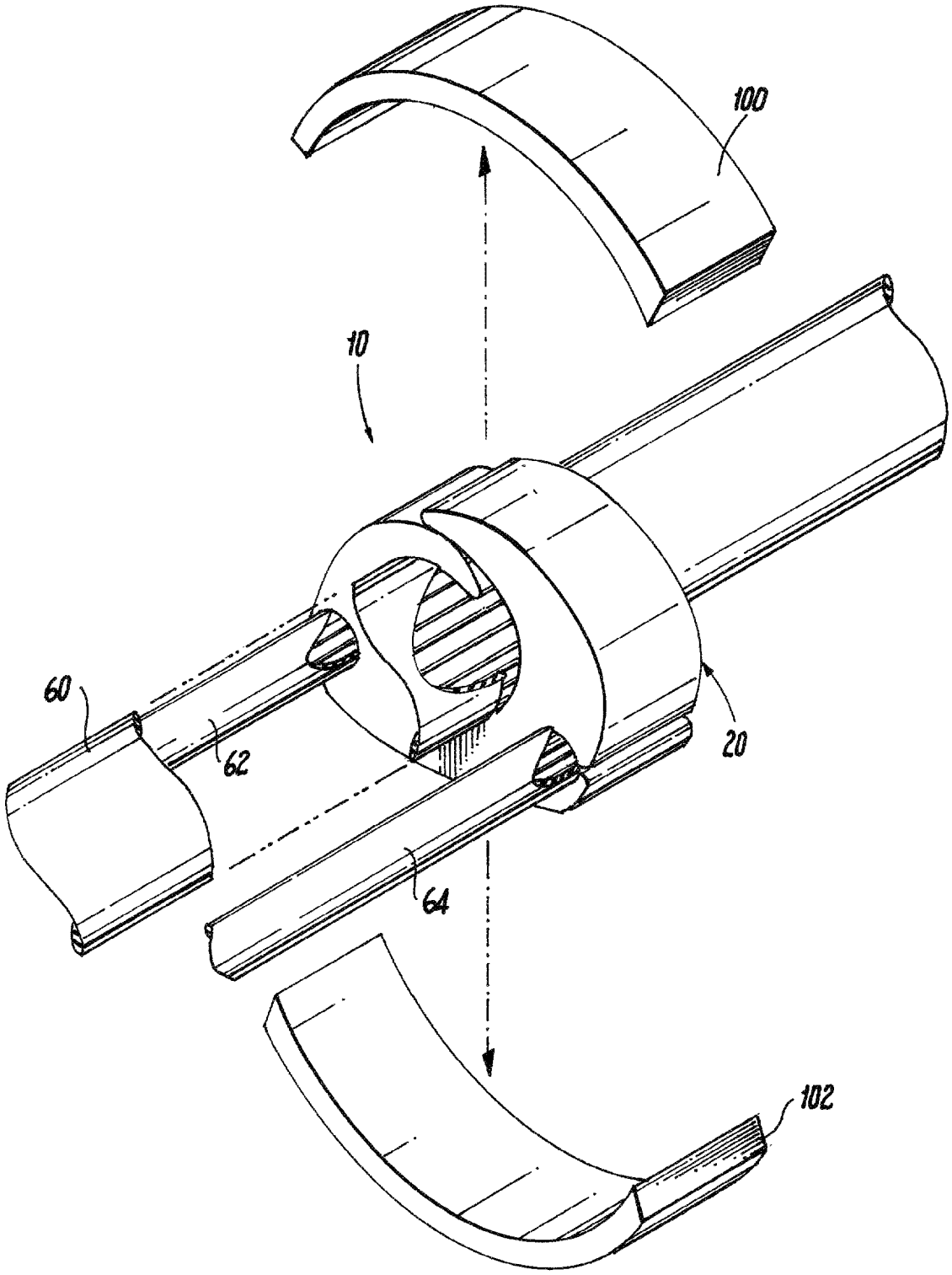
FIG. 3 is a perspective view of the compression connector of FIG. 2 where the compression connector has been subjected to a crimping operation to electrically connect a run conductor to two branch conductors and the dies of the crimping tool being removed.

The present disclosure provides embodiments of compression connectors used to electrically connect, for example, one or more branch or tap conductors to one or more run or main conductors in such a way that either the entire branch conductor or one or more strands of the branch conductor remain within their respective opening, port, slot, channel, aperture or the like. For ease of description, the compression connector may be referred to as the "connector" in the singular and the "connectors" in the plural. The branch or tap conductors may be referred to as the "branch conductor" in the singular and the "branch conductors" in the plural. The main or run conductors may be referred to as the "run conductor" in the singular and the "run conductors" in the plural. The port, slot, channel, aperture or other opening that receives the branch conductors may also be referred to as the "branch opening" in the singular and the "branch openings" in the plural. The port, slot, channel, aperture or other opening that receives the run conductors may also be referred to as the "run opening" in the singular and the "run openings" in the plural.

Referring to FIGS. 1 and 2, an exemplary embodiment of a compression connector according to the present disclosure is shown. In this exemplary embodiment, the connector 10 includes a body 20 having a run conductor portion 22 and a branch conductor portion 24. The run conductor portion 22 includes two side walls 26 and 28, an opening 30 between the two side walls and a rounded bottom wall 32 between the two side walls 26 and 28 that define a portion of the opening 30. One of the walls 26 or 28 may include a more rounded shape at its free end than the other wall so that when the connector 10 is compressed, e.g., crimped, the more rounded end can overlay the run conductor. In the exemplary embodiment shown, the run conductor portion 22 is substantially a C-shaped structure with the rounded bottom wall 32 shaped to receive a run conductor. The configuration of the opening 30 can vary depending upon the size of the run conductor. As a non-limiting example, the run conductor can range from about 250-750 Kcmil.

The branch connector portion 24 includes one or more branch conductor openings. Each branch conductor opening can be configured and dimensioned to receive one or more branch conductors. In the embodiment shown, the branch conductor portion 24 includes two branch conductor openings 40 and 50. Branch conductor opening 40 extends along the width of the body 20 as shown and has a lead-in 42 defined by ribs 44 and 46. The ribs 44 and 46 help retain a branch conductor within the opening 40 until the connector 10 is compressed, e.g., crimped. The branch conductor portion 24 also includes a first hinge portion 48 that enables rib 46 to more easily bend toward rib 44 when being compressed, e.g., crimped. Branch conductor opening 50 extends along the width of the body 20 as shown and has a lead-in 52 defined by ribs 54 and 56. The ribs 54 and 56 help retain a branch conductor within the opening 50 until compressed. The branch conductor portion 24 also includes a second hinge portion 58 that enables rib 56 to more easily bend toward rib 54 when being compressed, e.g., crimped. When the connector 10 is compressed, using for example a standard hydraulic crimping tool (not shown), the hinge portions 48 and 58 bend first to prevent the branch conductors or strands of the branch conductors from exiting the respective opening via lead-ins 42 and 52.

Referring to FIGS. 2 and 3, it is noted that the run conductors 60 are typically greater in size than the branch conductors 62 and 64. Further, the run conductors 60 and the branch conductors 62 and 64 can be solid conductors or they can be stranded conductors. Typically, the run conductors and branch conductors are stranded conductors, as shown.

To secure the run and branch conductors to the connector 10, the connector is placed in a standard crimping tool (not shown), such as a hydraulic 12-ton or 15-ton hand held power tool, that has die surfaces 100 and 102, seen in FIGS. 2 and 3, in a working head of the tool. An example of a hydraulic power tool is the PAT46-18V manufactured by Burndy, LLC. When the tool is actuated, the connector 10 would come into contact with the interior surfaces of the dies, such that a compressive force applied to the dies is transferred to the connector 10 causing the connector to compress. As the tool is compressing the connector 10, the hinges 48 and 58 would typically bend first securing the branch conductors 62 and 64 within their respective openings 40 and 50 and preventing strands of the branch conductors from exiting the openings. As additional compressive force is applied to the connector 10, the wall 26 folds and then the wall 28 folds to secure the run conductor to the connector. The conductors provided in openings 30, 40 and 50 will receive direct compressive loads due to the unique geometric relationship between the connector 10 and the dies of the tool. After the crimping process is completed, the conductors 60, 62 and 64 provided in their respective openings would be secured in place, i.e., crimped to the connector 10.

Figure 4:
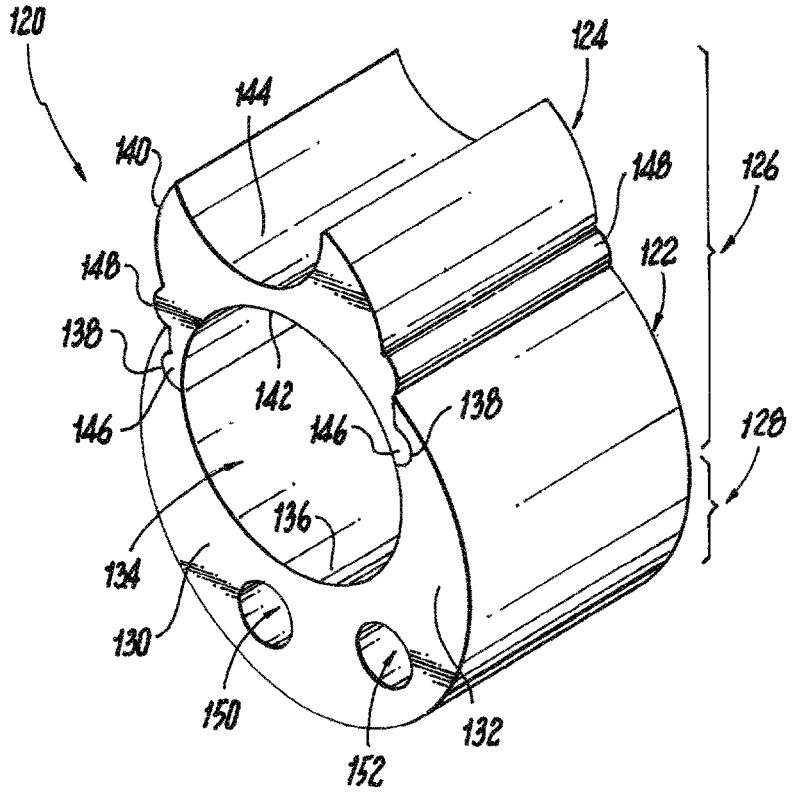
FIG. 4 is a perspective view of another exemplary embodiment of a compression connector according to the present disclosure, illustrating an adapter mated with a connector body so that the compression connector can connect conductors of a first predefined size range to smaller size conductors.
Figure 5:
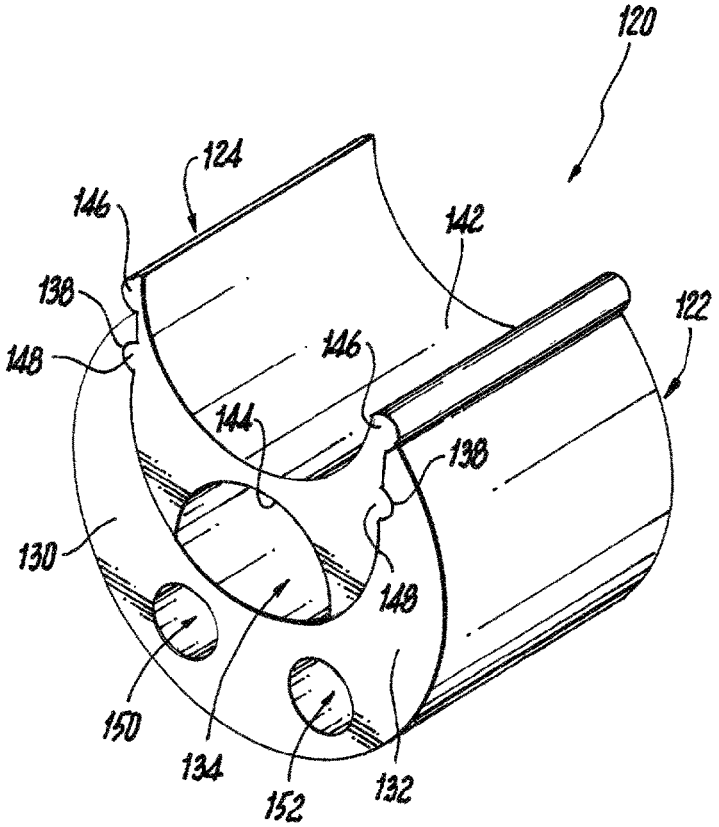
FIG. 5 is a perspective view of the compression connector of FIG. 4 with the adapter mated with the connector body so that the compression connector can connect conductors of a second predefined size range to the smaller size conductors.
Figure 6:
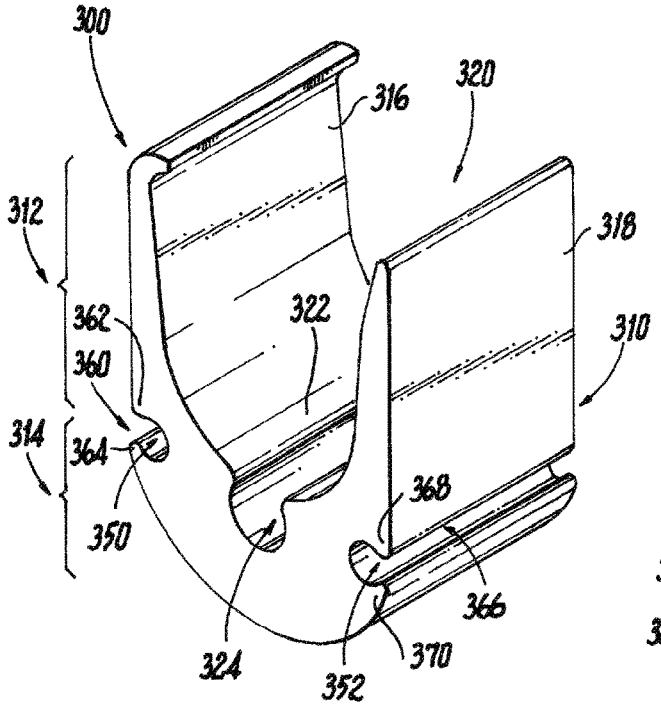
FIG. 6 is a perspective view of another exemplary embodiment of compression connector according to the present disclosure, illustrating a connector body configured to mate with an adapter so that the compression connector can connect conductors of first and second predefined size ranges.
Figure 7:
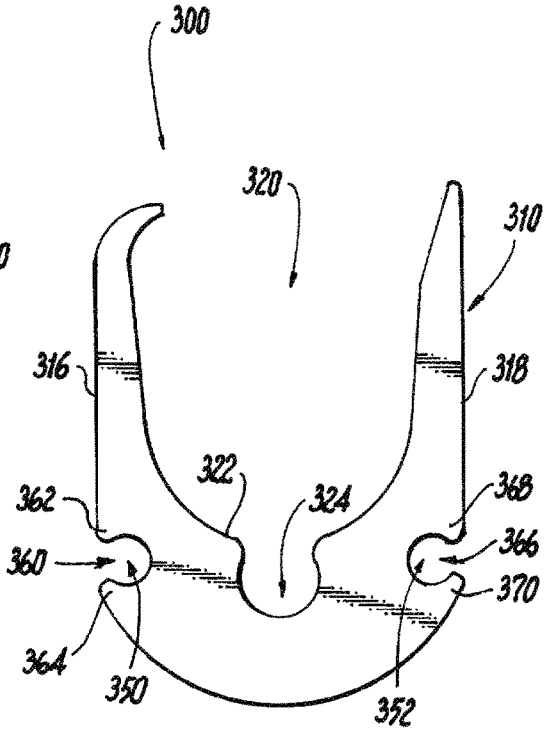
FIG. 7 is a side elevation view of the compression connector of FIG. 6.

Referring now to FIGS. 4 and 5, another exemplary embodiment of a connector according to the present disclosure is shown. In this exemplary embodiment, the connector 120 has a body 122 and an adapter 124 that can be mated with the body 122. The body 122 includes a run conductor portion 126 and a branch conductor portion 128. The run conductor portion 126 includes two side walls 130 and 132, an opening 134 between the two side walls and a rounded bottom wall 136 between the two side walls 130 and 132 that define a portion of the opening 134. Each wall 130 and 132 may include a track 138 used to releasably secure the adapter 124 to the body 122. The adapter 124 is an H-shape like member having an adapter body 140 with a first arcuate surface 142 and a second arcuate surface 144 that are on opposite sides of the adapter body 140, as shown. The diameter of the first arcuate surface 142 is configured and dimensioned to receive larger sized run conductors, and the second arcuate surface 144 is configured and dimensioned to receive smaller sized run conductors. On the outer periphery of the body 140 are two sets of tabs used to mate the adapter 124 to the body 122. The tabs 146 form the first set of tabs and tabs 148 from the second set of tabs. When larger sized run conductors 60, e.g., run conductors of about 500 Kcmil or greater in size, are to be connected to branch conductors, the tabs 146 of the adapter body 140 are inserted into tracks 138 in the body 122 so that the arcuate surface 142 is facing the rounded bottom surface 136 of the opening 134, as seen in FIG. 4. The tabs 146 are held in place within the tracks 138 by, for example, a friction fit, a spring fit or a tension fit. When smaller sized run connectors 60, e.g., run conductors of about 2/0 AWG in size to about 350 Kcmil in size, are to be connected to branch conductors, the adapter 124 is rotated so that arcuate surface 144 is facing the rounded bottom surface 136 of the opening 134, and the tabs 148 are slide into tracks 138 in the body 122, as seen in FIG. 5. As noted, the configuration of the opening 134 can vary depending upon the size of the run conductor. As a non-limiting example, the run conductor can range from about 250-750 Kcmil. In this exemplary embodiment, the branch connector portion 128 includes one or more branch conductor openings. Each branch conductor opening can be configured and dimensioned to receive one or more branch conductors. In the embodiment shown, the branch conductor portion 128 includes two branch conductor openings 150 and 152. The branch conductor openings 150 and 152 extend along the width of the body 122 as shown. It is noted that the examples of the size of the run conductor openings are non-limiting such that the connector 10 can be configured and dimensioned to receive a wide variety sized run conductors.

Figure 8:
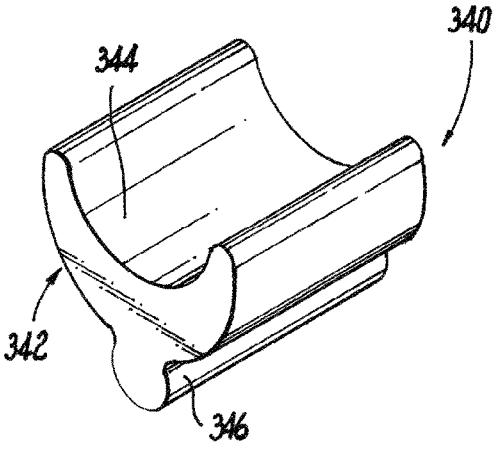
FIG. 8 is a perspective view of an adapter that can mate with the body of the compression connector FIG. 6.
Figure 9:
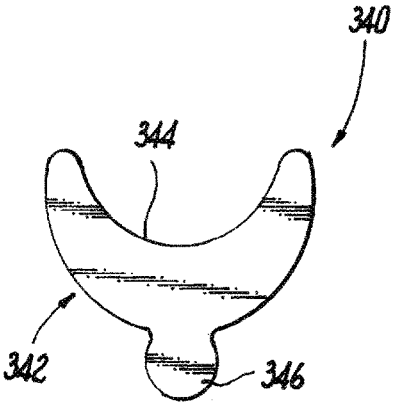
FIG. 9 is a side elevation view of the adapter of FIG. 8.
Figure 10:
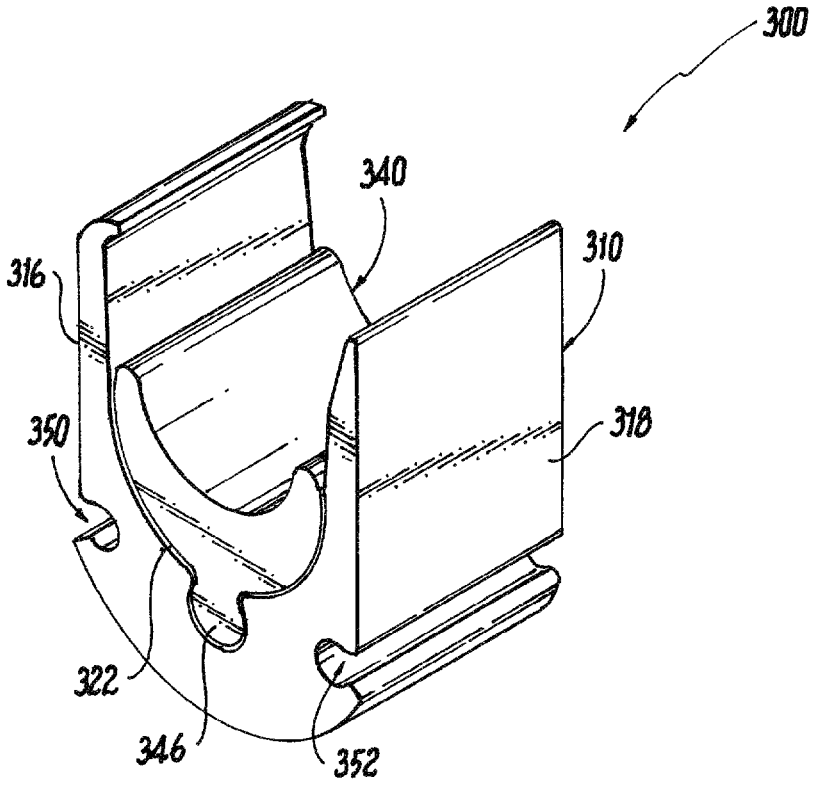
FIG. 10 is perspective of the compression connector body of FIG. 6 mated with the adapter of FIG. 8.
Figure 11:
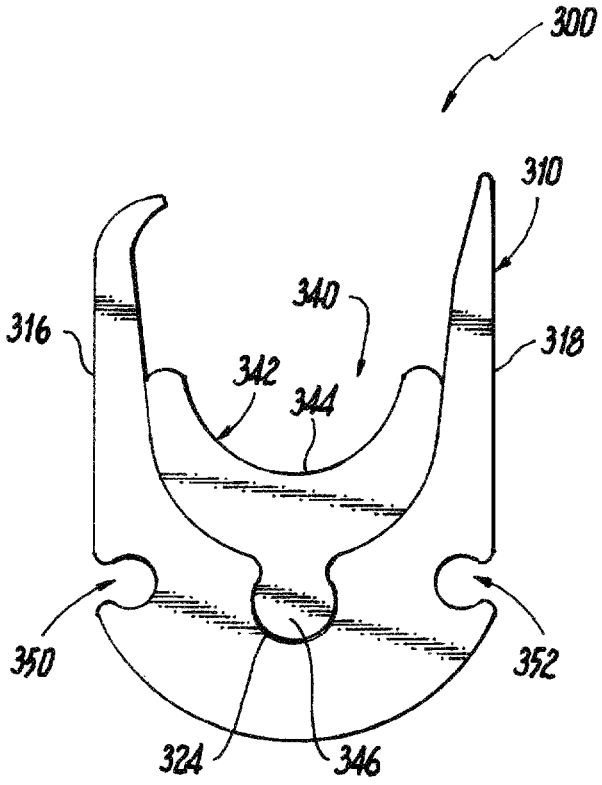
FIG. 11 is a side elevation view of the compression connector body mated with the adapter of FIG. 10.

Referring now to FIGS. 6-11, another exemplary embodiment of a connector according to the present disclosure is shown. In this exemplary embodiment, the connector 300 has a body 310 and an adapter 340 that can be mated with the body 310. The body 310 includes a run conductor portion 312 and a branch conductor portion 314. The run conductor portion 312 includes two side walls 316 and 318, an opening 320 between the two side walls and a rounded bottom wall 322 between the two side walls 316 and 318 that define a portion of the opening 320. The diameter of the opening 320 defined by the rounded bottom wall 322 is configured and dimensioned to receive larger sized run conductors, e.g., run conductors of about 500 Kcmil or greater in size. The rounded bottom wall 322 may include a track 324 used to releasably secure the adapter 340 to the body 310. The adapter 340, seen in FIGS. 8 and 9, is a U-shape like member having an adapter body 342 with an arcuate surface 344 on which a run conductor can rest. The diameter of the arcuate surface 344 is configured and dimensioned to receive smaller sized run conductors, e.g., run conductors of about 2/0 AWG in size to about 350 Kcmil in size. The configuration of the opening 320 can vary depending upon the size of the run conductor. As a non-limiting example, the run conductor can range from about 250-750 Kcmil. Extending from an outer periphery of the adapter body 342 is a rail 346 which is configured to slidably engage with the track 324 in the rounded bottom wall 322. The rail 346 is held in place within the track 324 by, for example, a friction fit, a spring fit or a tension fit. When larger sized run connectors are to be connected to branch conductors, the adapter 340 is removed from the connector body 310. When smaller sized run connectors are to be connected to branch conductors, the adapter 340 is positioned within the opening 320 by sliding the rail 346 of the adapter 340 through the track 324 of the body 310.

The branch connector portion 314 includes one or more branch conductor openings. Each branch conductor opening can be configured and dimensioned to receive one or more branch conductors. In the embodiment shown, the branch conductor portion 314 includes multiple, e.g., two, branch conductor openings 350 and 352. Branch conductor opening 350 extends along the width of the body 310 as shown and has a lead-in 360 defined by ribs 362 and 364. The ribs 362 and 364 help retain a branch conductor within the opening 350 until the connector 300 is compressed, e.g., crimped. Branch conductor opening 352 extends along the width of the body 310 as shown and has a lead-in 366 defined by ribs 368 and 370. The ribs 368 and 370 help retain a branch conductor within the opening 352 until the connector 300 is compressed, e.g., crimped.

Turning to FIGS. 12 and 13, another exemplary embodiment of the connector according to the present disclosure is shown. This exemplary embodiment of the connector 400 is substantially similar to the embodiment of FIGS. 1-3 such that common elements are numbered the same and a description of them is not repeated. In this exemplary embodiment, the connector 400 also includes a movable conductor retainer 410 that is coupled to or formed into one of the side walls 26 or 28 of the connector body 20 via living hinge 412. In the embodiment shown, the conductor retainer 410 is coupled to the side wall 26 via the living hinge 412. When a run conductor 60 is positioned within the opening 30 of the connector body 20, the conductor retainer 410 can be moved, e.g., rotated or pivoted, until the free end 410*a* of the conductor retainer 410 is adjacent to the free end 28*a* of the side wall 28 to at least temporarily hold the run conductor within the opening 30 until crimped.

Figure 14:
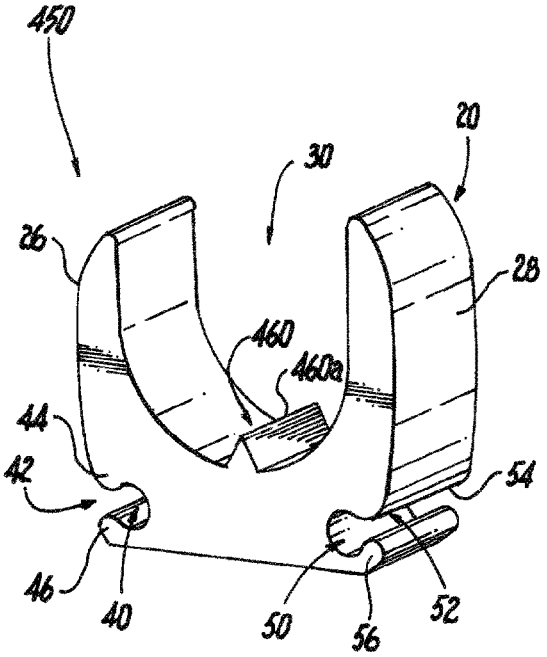
FIG. 14 is a perspective view of another exemplary embodiment of a compression connector according to the present disclosure, illustrating an insulation piercing member extending from an interior wall forming an opening of the compression connector.
Figure 15:
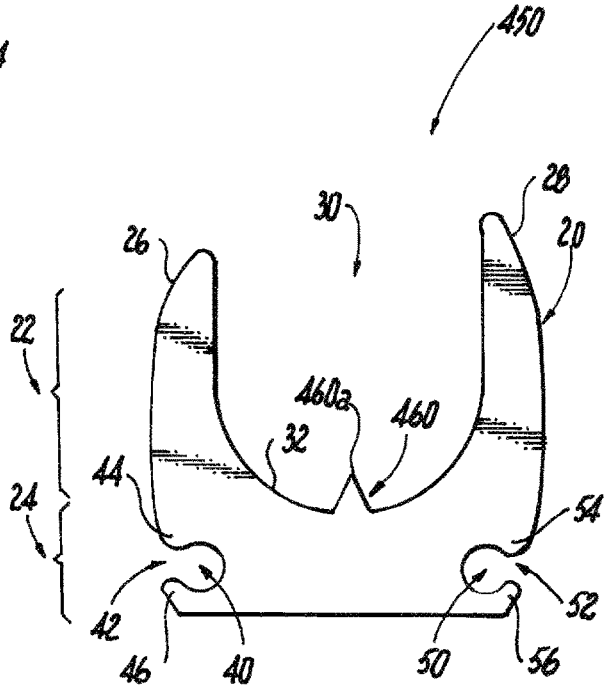
FIG. 15 is a side elevation view of the compression connector of FIG. 14.
Figure 16:
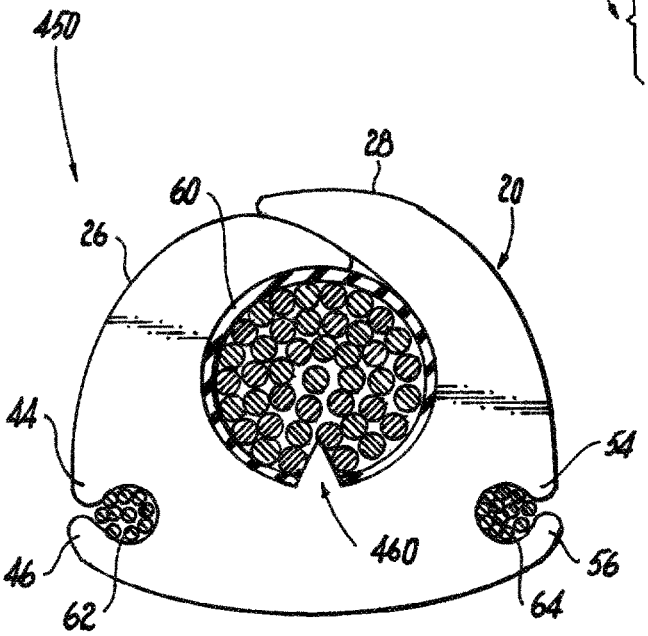
FIG. 16 is a side elevation view of the compression connector of FIG. 14 after a crimping operation, illustrating a run conductor within the opening of the compression connector and the insulation piercing member in contact with electrical wires within the run conductor.

Turning to FIGS. 14-16, another exemplary embodiment of the connector according to the present disclosure is shown. This exemplary embodiment of the connector 450 is substantially similar to the embodiment of FIGS. 1-3 such that common elements are numbered the same and a description of them is not repeated. In this exemplary embodiment, the connector 450 also includes one or more insulation piercing members 460 extending from an inner surface of one or more walls 26, 28 and/or 32. In the embodiment shown, a single insulation piercing member 460 extends from the bottom wall 32 into the opening 30. In this exemplary embodiment, the insulation piercing member 460 extends along the width of the body 20, as shown, and includes an insulation piercing tip 460*a* that is configured and dimensioned to pierce or cut through insulation surrounding the run conductor 60 when the connector 450 is crimped such that electrical wires within the run conductor 60 contact the insulation piercing member 460 to create an electrical path between the connector 450 and the electrical wires within the run conductor 60, as shown in FIG. 16. However, the insulation piercing members 460 may come in different shapes and sizes configured and dimensioned to pierce or cut through insultation surrounding electrical wires, such as a cone-shaped member or a member with a pointed tip. Further, the insulation piercing members 460 may include a serrated tip to assist in the piercing through insulation surrounding the electrical wires.

Figure 17:
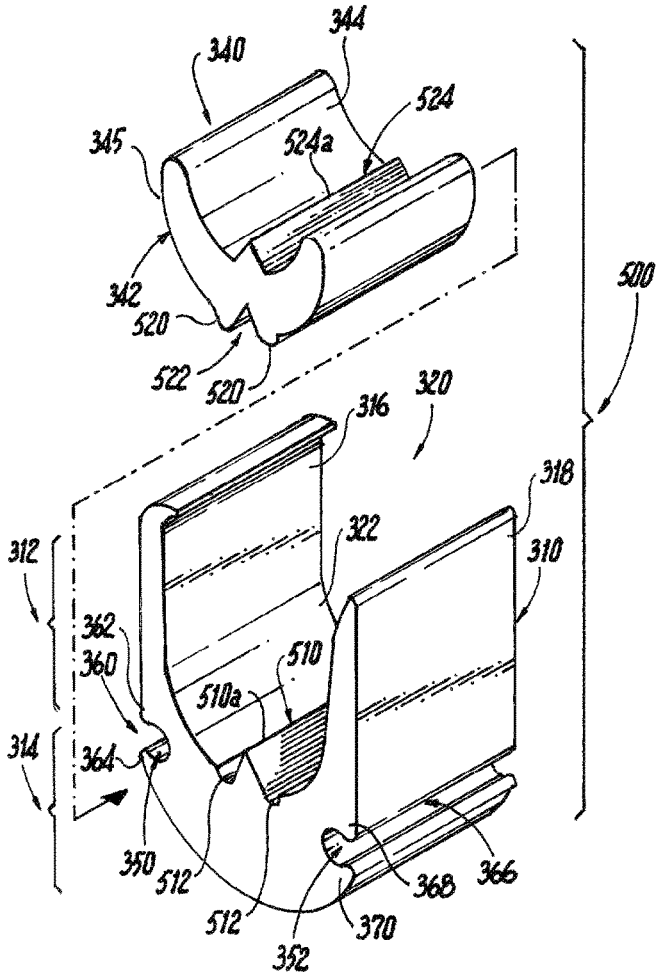
FIG. 17 is a perspective view of another exemplary embodiment of compression connector according to the present disclosure, illustrating a connector body configured to mate with an adapter so that the compression connector can connect conductors of first and second predefined size ranges and illustrating an insulation piercing member extending from an interior wall forming a run conductor opening of the body and an insulation piercing member extending from a wall of the adapter.
Figure 18:
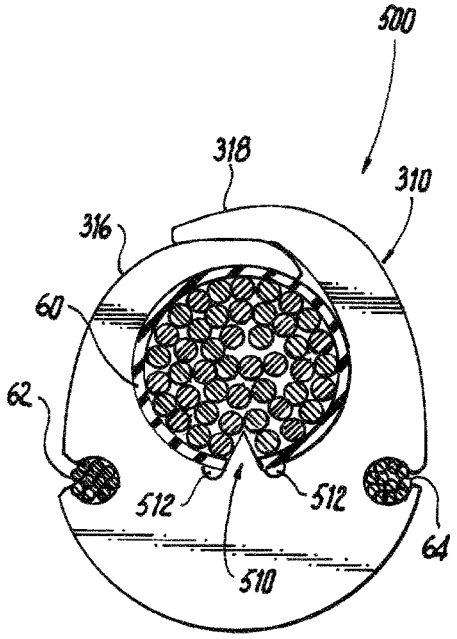
FIG. 18 is a side elevation view of the connector body of FIG. 17 after a crimping operation, illustrating a run conductor within the opening of the compression connector and the insulation piercing member in contact with electrical wires within the run conductor.
Figure 19:
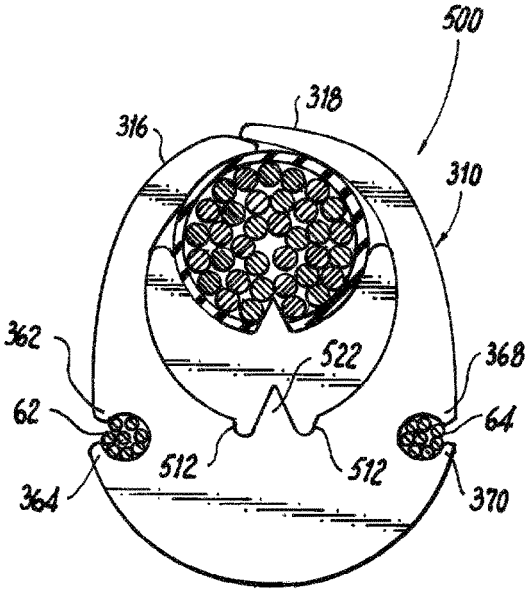
FIG. 19 is a side elevation view of the adapter coupled to the connector body of FIG. 17 after a crimping operation, illustrating a run conductor on the adapter within the opening of the compression connector and the adapter insulation piercing member in contact with electrical wires within the run conductor.

Referring to FIGS. 17-19, another exemplary embodiment of the connector according to the present disclosure is shown. This exemplary embodiment of the connector 500 is substantially similar to the embodiment of FIGS. 6-11 such that common elements are numbered the same and a description of them is not repeated. In this exemplary embodiment, the connector 500 has a body 310 and an adapter 340 that can be mated with the body 310 as described above. The body 310 includes one or more insulation piercing members 510 extending from an inner surface of one or more walls 316, 318 and/or 322. In the embodiment shown, a single insulation piercing member 510 extends from the bottom wall 322 into the opening 320. In this exemplary embodiment, the insulation piercing member 510 extends along the width of the body 310, as shown, and includes an insulation piercing tip 510*a* that is configured and dimensioned to pierce or cut through insulation surrounding a run conductor 60 when the connector 500 is crimped such that electrical wires within the run conductor 60 contact the insulation piercing member 510 to create an electrical path between the connector 500 and electrical wires within the run conductor 60, as shown in FIG. 18. However, the insulation piercing member 510 may come in different shapes and sizes configured and dimensioned to pierce or cut through insulation surrounding electrical wires, such as a cone-shaped member or a member with a pointed tip. Further, the insulation piercing members 510 may include a serrated tip to assist in the piercing through insulation surrounding the electrical wires. In this exemplary embodiment, each side of the insulation piercing member 510 includes a track 512 in the bottom wall 322. The tracks 512 are used to releasably secure the adapter 340 to the body 310, as described below.

The adapter 340, seen in FIGS. 17 and 19, is a U-shape like member having an adapter body 342 with an inner arcuate surface 344 on which a run conductor can rest. Extending from an outer surface 345 of the adapter body 342 are rails 520 which are configured to slidably engage with the tracks 512 in the rounded bottom wall 322. The adapter body 342 also includes a channel 522 that is configured and dimensioned to receive at least a portion of the insulating piercing member 510. When smaller sized run connectors are to be connected to branch conductors, the adapter 340 is inserted into the opening 320 by sliding the rails 520 of the adapter 340 through the tracks 512 of the body 310 and the insulating piercing member 510 through the channel 522 in the adapter 340.

In this exemplary embodiment, one or more insulation piercing members 524 may extend from the the inner arcuate surface 344 of the adapter 340. In the embodiment shown, a single insulation piercing member 524 extends from the arcuate surface 344. The insulation piercing member 524 extends along the width of the adapter body 340, as shown, and includes an insulation piercing tip 524*a* that is configured and dimensioned to pierce or cut through insulation surrounding a run conductor 60 when the connector 500 is crimped such that electrical wires within the run conductor 60 contact the insulation piercing member 524 to create an electrical path between the connector 500 and the electrical wires within the run conductor 60, as shown in FIG. 19. However, the insulation piercing members 524 may come in different shapes and sizes configured and dimensioned to pierce or cut through insulation surrounding electrical wires, such as a cone-shaped member or a member with a pointed tip. Further, the insulation piercing members 524 may include a serrated tip to assist in the piercing through insulation surrounding the electrical wires.

Figure 20:
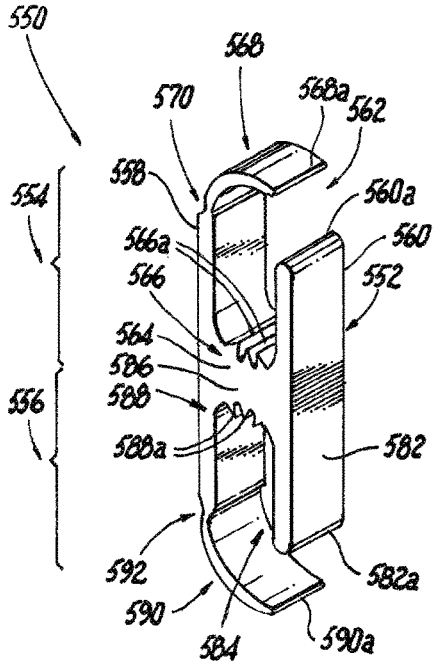
FIG. 20 is a perspective view of another exemplary embodiment of compression connector according to the present disclosure, illustrating an H-shaped connector body configured with two openings for receiving run conductors with each opening having a movable conductor retainer coupled to a body and insulation piercing members extending from an interior wall forming the conductor opening.
Figure 21:
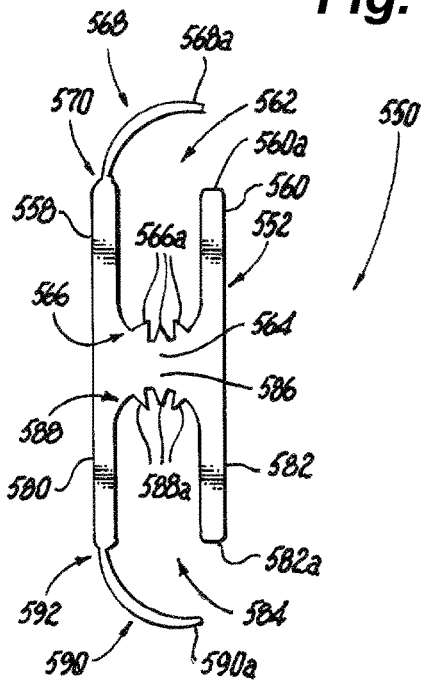
FIG. 21 is a side elevation view of the compression connector of FIG. 20.

Referring to FIGS. 20 and 21 another exemplary embodiment of the connector of the present disclosure is shown. In this exemplary embodiment, the connector 550 is an H-shape like member having a body 552 having a first conductor portion 554 and a second conductor portion 556. The first conductor portion 554 includes two side walls 558 and 560, an opening 562 between the side walls 558 and 560, and a bottom wall 564 between the side walls 558 and 560 that define a portion of the opening 562. One of the walls 558 or 560 may include a more rounded shape at its free end than the other wall so that when the connector 550 is compressed, e.g., crimped, the more rounded end can overlay a conductor within the opening 562. The first conductor portion 554 of the connector 550 also includes one or more insulation piercing members 566 extending from an inner surface of one or more walls 558, 560 and/or 564. In the embodiment shown, a plurality of insulation piercing members 566 extend from the bottom wall 564 into the opening 562. In this exemplary embodiment, the insulation piercing members 566 extend along the width of the body 552, as shown, and include an insulation piercing tip 566*a* that is configured and dimensioned to pierce or cut through insulation surrounding a conductor, e.g., a run conductor 60, when the connector 550 is crimped such that electrical wires within the conductor contact the insulation piercing member 566 to create an electrical path between the connector 550 and electrical wires within the conductor. The first conductor portion 554 also includes a movable conductor retainer 568 that is coupled to or formed into one of the side walls 558 or 560 of the connector body 552 via living hinge 570. In the embodiment shown, the conductor retainer 568 is coupled to the side wall 558 via the living hinge 570. When a conductor, e.g., a run conductor 60, is positioned within the opening 562 of the first conductor portion 554, the conductor retainer 568 can be moved, e.g., rotated or pivoted, until the free end 568*a* of the conductor retainer 568 is adjacent the free end 560*a* of the side wall 560 to at least temporarily hold the conductor within the opening 562 until the connector 550 is crimped to the conductor. An inside surface of the conductor retainer 568 may also include one or more insulation piercing members similar to insulation piercing members 566 such that when the connector 550 is crimped the electrical wires within the conductor contact the insulation piercing members extending from conductor retainer 568 to create an additional electrical path between the connector 550 and electrical wires within the conductor.

The second conductor portion 556 of the body 552 includes two side walls 580 and 582, an opening 584 between the side walls 580 and 582, and a bottom wall 586 between the side walls 580 and 582 that define a portion of the opening 584. One of the walls 580 or 582 may include a more rounded shape at its free end than the other wall so that when the connector 550 is compressed, e.g., crimped, the more rounded end can overlay a conductor within the opening 584. The second conductor portion 556 of the connector 550 also includes one or more insulation piercing members 588 extending from an inner surface of one or more walls 580, 582 and/or 586. In the embodiment shown, a plurality of insulation piercing members 588 extend from the bottom wall 586 into the opening 584. In this exemplary embodiment, the insulation piercing members 588 extend along the width of the body 552, as shown, and include an insulation piercing tip 588*a* that is configured and dimensioned to pierce or cut through insulation surrounding a conductor, e.g., a run conductor 60, when the connector 550 is crimped such that electrical wires within the conductor contact the insulation piercing member 588 to create an electrical path between the connector 550 and electrical wires within the conductor. The second conductor portion 556 also includes a movable conductor retainer 590 that is coupled to or formed into one of the side walls 580 or 582 of the connector body 552 via living hinge 592. In the embodiment shown, the conductor retainer 590 is coupled to the side wall 580 via the living hinge 592. When a conductor, e.g., a run conductor 60, is positioned within the opening 584 of the second conductor portion 556, the conductor retainer 590 can be moved, e.g., rotated or pivoted, until the free end 590*a* of the conductor retainer 590 is adjacent to the free end 582*a* of the side wall 582 to at least temporarily hold the conductor within the opening 584 until the connector 550 is crimped to the conductor. An inside surface of the conductor retainer 590 may also include one or more insulation piercing members similar to insulation piercing members 588 such that when the connector 550 is crimped the electrical wires within the conductor contact the insulation piercing members extending from conductor retainer 590 to create an additional electrical path between the connector 550 and electrical wires within the conductor.

It is noted that in the exemplary embodiment shown in FIGS. 20 and 21, the first conductor portion 554 and the second conductor portion 556 are substantially U-shaped structures with the bottom walls 564 and 586 shaped to receive a conductor, e.g., a run conductor 60. The configuration of the openings 562 and 584 can vary depending upon the size of the conductor to be crimped. As a non-limiting example, the conductor can range from about 250-750 Kcmil. It is also noted that the insulation piercing members 566 and 588 may come in different shapes and sizes configured and dimensioned to pierce or cut through insulation surrounding electrical wires, such as a pointed tip. Further, the insulation piercing members 566 and 588 may include a serrated tip to assist in the piercing through any insulation surrounding the electrical wires.

Figure 22:
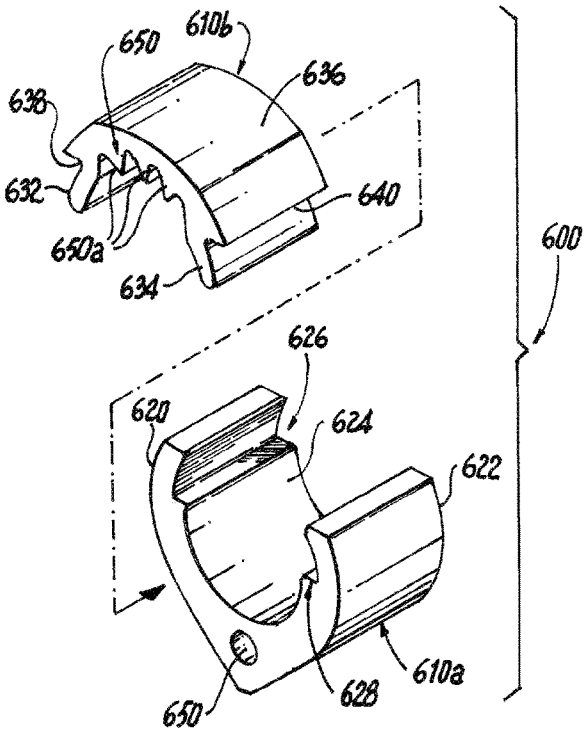
FIG. 22 is a perspective view of another exemplary embodiment of compression connector according to the present disclosure, illustrating a two-piece body where one of the pieces includes insulation piercing members extending into a central opening of the compression connector.
Figure 23:
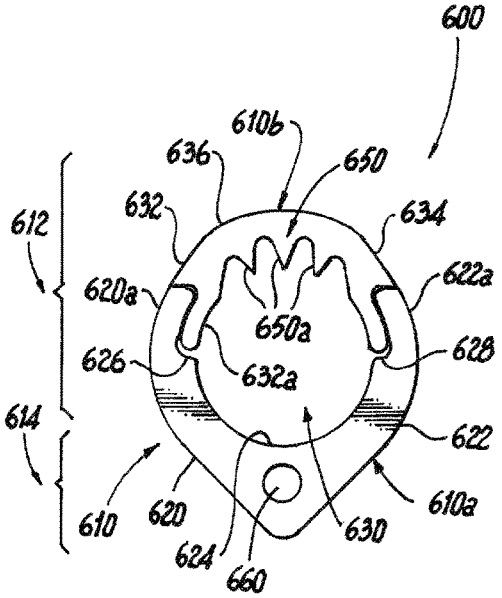
FIG. 23 is a side elevation view of the compression connector of FIG. 20.

Referring to FIGS. 22 and 23, another exemplary embodiment of the connector of the present disclosure is shown. In this exemplary embodiment, the connector 600 includes a body 610 having a lower body half 610*a* and an upper body half 610*b*. A portion of the lower body half 610*a* and the upper body half 610*b* encompass a run conductor portion 612 of the connector 600. Another portion of the lower body half 610*a* encompasses a branch conductor portion 614 of the connector, as seen in FIG. 23. The lower body half 610*a* encompassing the run conductor portion 612 includes side walls 620 and 622 and a rounded bottom wall 624 between the two side walls 620 and 622 that define a portion of an opening 630 within the body 610 configured and dimensioned to receive a run conductor 60. A free end 620*a* of the side wall 620 includes a notch 626, and a free end 622*a* of the side wall 622 includes a notch 628. The notches 626 and 628 are used to releasably attach the lower body half 610*a* to the upper body half 610*b* until the connector 600 is crimped.

Continuing to refer to FIGS. 22 and 23, the upper body half 610*b* includes side walls 632 and 634 and a rounded top wall 636 between the side walls 632 and 634 that defines another portion of the opening 630. The side wall 632 includes a free end 632*a* having a notch 638 configured and dimensioned to receive the free end 620*a* of the side wall 620. Similarly, the side wall 634 includes a free end 634*a* having a notch 640 configured and dimensioned to receive the free end 622*a* of the side wall 622, as shown. The upper body half 610*b* includes one or more insulation piercing members 650 extending from an inner surface of one or more walls 632, 634 and/or 636 of the upper body half 610*b*, as shown. In the embodiment shown, a plurality of insulation piercing members 650 extend from an inner surface of the top wall 636 into the opening 630. The insulation piercing members 650 extend along the width of the upper body half 610*b*, as shown, and include an insulation piercing tip 650*a* that is configured and dimensioned to pierce or cut through insulation surrounding a conductor, e.g., a run conductor 60, when the connector 600 is crimped such that electrical wires within the conductor contact the insulation piercing member 650 to create an electrical path between the connector 600 and electrical wires within the conductor. In addition, one or more insulation piercing members similar to insulation piercing members 650 may extend along the width of an inner surface of the lower body half 610*a* and include an insulation piercing tip that is configured and dimensioned to pierce or cut through insulation surrounding a conductor, e.g., a run conductor 60, when the connector 600 is crimped such that electrical wires within the conductor contact the insulation piercing members to create an additional electrical path between the connector 600 and electrical wires within the conductor.

To releasably attach the lower body half 610*a* to the upper body half 610*b*, the free ends 632*a* and 634*a* of the side walls 632 and 634, respectively, of the upper body half 610*b* are inserted into the notches 626 and 628 of the lower body half 610*a*. In addition, the free ends 620*a* and 622*a* of the side walls 620 and 622, respectively, of the lower body half 610*a* are inserted into the notches 638 and 640 of the upper body half 610*b*. The lower body half 610*a* is held in position relative to the upper body half 610*b* by a spring or tension fit or a friction fit. When the lower body half 610*a* is releasably attached to the upper body half 610*b*, the opening 630 is formed, as seen in FIG. 23.

The branch connector portion 614 of the connector 600 includes one or more branch conductor openings. Each branch conductor opening can be configured and dimensioned to receive one or more branch conductors. In the embodiment shown, the branch conductor portion 614 includes a single branch conductor opening 660 configured and dimensioned to receive a branch conductor.

Figure 24:
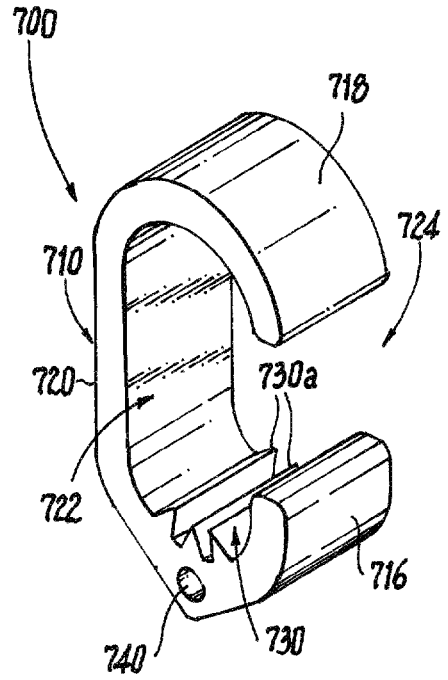
FIG. 24 is a perspective view of another exemplary embodiment of compression connector according to the present disclosure, illustrating a C-shaped connector body with an with opening for receiving a conductor and insulation piercing members extending from an interior wall into the opening.
Figure 25:
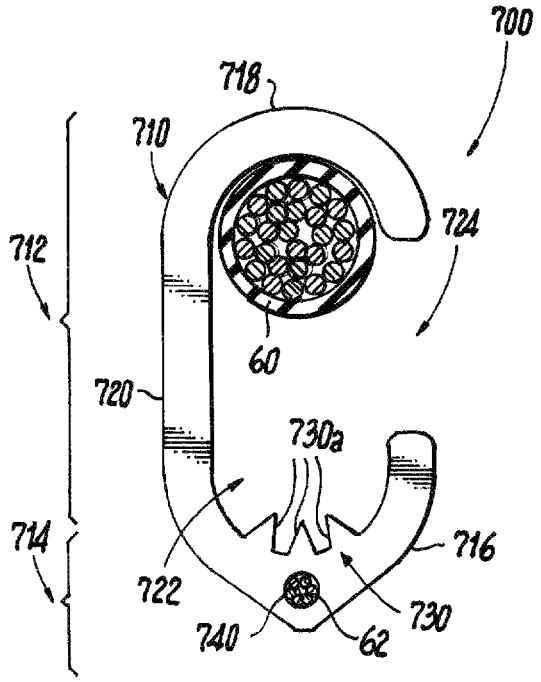
FIG. 25 is a side elevation view of the compression connector of FIG. 24.

Referring now to FIGS. 24 and 25, another exemplary embodiment of the connector of the present disclosure is shown. In this exemplary embodiment, the connector 700 includes a body 710 having a run conductor portion 712 and a branch conductor portion 714. The body 710 is a C-shaped like member having a first wall 716, a second wall 718 and a third wall 720 joining the first wall to the second wall. The body 710 also includes an opening 722 with a lead-in 724 where a run conductor 60 can pass into the opening 722. The second wall 718 in this exemplary embodiment is a hook like structure configured such that when a run conductor is passed into the opening 722, the connector 700 can rest on the run conductor 60 prior to crimping, as seen in FIG. 25. This permits a technician to set-up and operate a crimping tool without having to hold the connector as well.

The connector 700 may also include one or more insulation piercing members 730 extending from an inner surface of one or more walls 716, 718 and/or 720 of the body 710. In the embodiment shown, a plurality of insulation piercing members 730 extend from an inner surface of the first wall 716 into the opening 722. The insulation piercing members 730 extend along the width of the body 710, as shown, and include an insulation piercing tip 730*a* that is configured and dimensioned to pierce or cut through insulation surrounding a run conductor 60 when the connector 700 is crimped such that electrical wires within the conductor contact the insulation piercing member 730 to create an electrical path between the connector 700 and electrical wires within the conductor.

The branch connector portion 714 of the connector 700 includes one or more branch conductor openings. Each branch conductor opening can be configured and dimensioned to receive one or more branch conductors. In the embodiment shown, the branch conductor portion 714 includes a single branch conductor opening 740 configured and dimensioned to receive a branch conductor.

Figure 26:
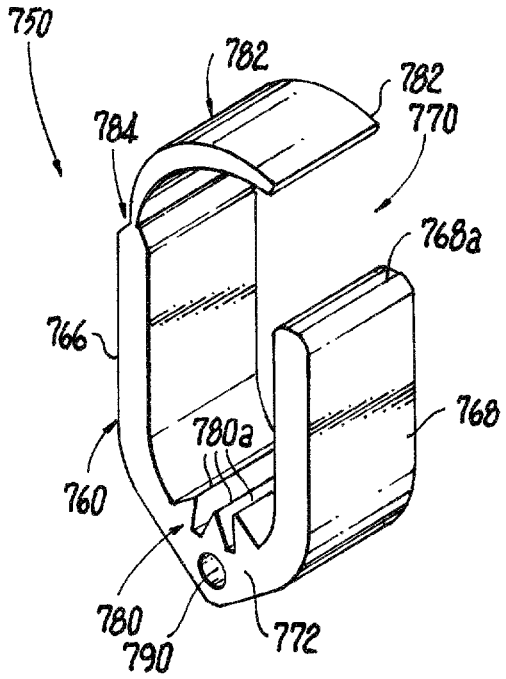
FIG. 26 is a perspective view of another exemplary embodiment of compression connector according to the present disclosure, illustrating a U-shaped connector body with an opening for receiving a conductor, insulation piercing members extending from an interior wall of the body into the opening and a movable conductor retainer coupled to a body.
Figure 27:
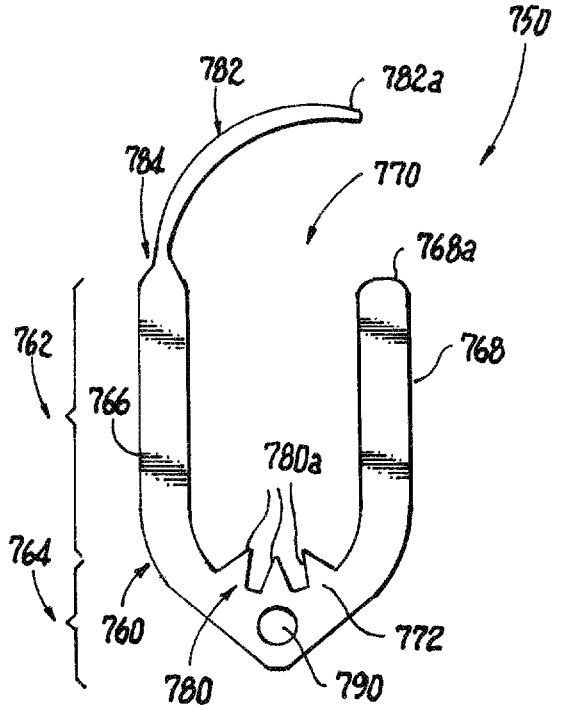
FIG. 27 is a side elevation view of the compression connector of FIG. 26.

Referring to FIGS. 26 and 27, another exemplary embodiment of the connector of the present disclosure is shown. In this exemplary embodiment, the connector 750 includes a body 760 having a run conductor portion 762 and a branch conductor portion 764. The run conductor portion 762 includes side walls 766 and 768, an opening 770 between the side walls and a rounded bottom wall 772 between the side walls 766 and 768 that defines a portion of the opening 770. One of the side walls 766 or 768 may include a more rounded shape at its free end than the other side wall so that when the connector 750 is compressed, e.g., crimped, the more rounded end can overlay the run conductor 60. In the exemplary embodiment shown, the run conductor portion 762 is a U-shaped like structure with the rounded bottom wall 772 shaped to receive a run conductor. The configuration of the opening 770 can vary depending upon the size of the run conductor. As a non-limiting example, the run conductor can range from about 250-750 Kcmil in size.

The connector 750 may also include one or more insulation piercing members 780 extending from an inner surface of one or more walls 766, 768 and/or 772 of the body 760. In the embodiment shown, a plurality of insulation piercing members 780 extend from an inner surface of the bottom wall 772 into the opening 770. The insulation piercing members 780 extend along the width of the body 760, as shown, and include an insulation piercing tip 780*a* that is configured and dimensioned to pierce or cut through insulation surrounding a run conductor 60 when the connector 750 is crimped such that electrical wires within the conductor contact the insulation piercing member 780 to create an electrical path between the connector 750 and electrical wires within the conductor.

The connector 750 may also include a movable conductor retainer 782 that is coupled to or formed into one of the side walls 766 or 768 of the connector body 760 via living hinge 784. In the embodiment shown, the conductor retainer 782 is coupled to the side wall 766 via the living hinge 784. In this exemplary embodiment, when a run conductor 60 is positioned within the opening 770 of the connector body 760, the conductor retainer 782 can be moved, e.g., rotated or pivoted, until the free end 782*a* of the conductor retainer 782 is adjacent the free end 768*a* of the side wall 768 to at least temporarily hold the run conductor within the opening 770 until crimped. An inside surface of the conductor retainer 782 may also include one or more insulation piercing members similar to insulation piercing members 730 such that when the connector 700 is crimped the electrical wires within the conductor contact the insulation piercing members extending from conductor retainer 782 to create an additional electrical path between the connector 700 and electrical wires within the conductor.

The branch connector portion 764 of the connector 750 includes one or more branch conductor openings. Each branch conductor opening can be configured and dimensioned to receive one or more branch conductors. In the embodiment shown, the branch conductor portion 764 includes a single branch conductor opening 790 configured and dimensioned to receive a branch conductor.

Referring to FIGS. 28 and 29, another exemplary embodiment of the connector of the present disclosure is shown. In this exemplary embodiment, the connector 800 includes a body 810 having a run conductor portion 812 and a branch conductor portion 814. The body 810 is a C-shaped like member having a first wall 816, a second wall 818 and a third wall 820 joining the first wall to the second wall. The body 810 also includes an opening 822 with a lead-in 824 where a run conductor 60 can pass into the opening 822. The second wall 818 in this exemplary embodiment is a hook like structure configured such that when a run conductor is passed into the opening 822, the connector 800 can rest on the run conductor 60 prior to crimping, as shown. This permits a technician to set-up and operate a crimping tool without having to hold the connector as well.

The connector 800 may also include one or more insulation piercing members 830 that can be removably attached to the body 810. The insulation piercing members 830 may come in different shapes and sizes configured and dimensioned to pierce or cut through insultation surrounding electrical wires, such as cone-shape like member or a member having a pointed tip. The insulation piercing members 830 can be removably attached to one or more walls 816, 818 and/or 820 of the body 810 so that at least an insulation piercing tip 836 extends into the conductor opening 822. For example, in the embodiment shown, the insulation piercing member 830 has a T-shaped rail 832 that mates with a T-shaped track 834 in the body 810 such that the insulation piercing tip 836 extends into the conductor opening 822. The insulation piercing member 830 can be held in place in the body 810 by, for example, a friction fit, a spring fit or a tension fit. The insulation piercing members 830 may extend along the full width of the body 810, as shown, or a portion of the body. The insulation piercing tip 836 is configured and dimensioned to pierce or cut through insulation surrounding a conductor, e.g., a run conductor 60.

In the embodiment shown in FIGS. 28 and 29, a single insulation piercing member 830, which is a cone-shaped like member, is removably attached to the body 810 and extends from an inner surface of the first wall 816 into the conductor opening 822. When a conductor, e.g., a run conductor 60, is inserted into the conductor opening 822 and the connector 800 is crimped using a known crimping tool, the insulation piercing member 830 pierces insulation surrounding electrical wires in the conductor so that the electrical wires contact the insulation piercing member 830 creating an electrical path between the connector 800 and electrical wires.

The branch connector portion 814 of the connector 800 includes one or more branch conductor openings. Each branch conductor opening can be configured and dimensioned to receive one or more branch conductors. In the embodiment shown, the branch conductor portion 814 includes a multiple, e.g., two, branch conductor openings 840 and 842. Branch conductor opening 840 extends along the width of the body 810 as shown and has a lead-in 844 defined by rib 846 and the body 810 as shown. The rib 846 helps retain one or more branch conductors within the opening 840 until the connector 800 is compressed, e.g., crimped. Branch conductor opening 842 extends along the width of the body 810 as shown and has a lead-in 848 defined by rib 850 and the body 810. The rib 850 helps retain one or more branch conductors within the opening 842 until the connector 800 is compressed, e.g., crimped.

The connectors described in the present disclosure can be manufactured from tin-plated copper, aluminum or similar metallic materials which would appropriately deform when pressure is applied in standard mechanical, hydraulic and pneumatic crimping tools and devices to crimp the conductors to the connectors. Further, the branch conductor openings disclosed and described herein may also include one or more insulation piercing members, similar to the insulation piercing members described herein, that are configured and dimensioned to pierce insulation surrounding branch conductors.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. An electrical compression connector for connecting a plurality of conductors, the compression connector comprising:

a connector body of compressible material adapted to be inserted into a crimping tool having two opposed curved die surfaces for the compression of the connector body, the connector body having a run conductor portion and a branch conductor portion;

wherein the run conductor portion includes a pair of side walls joined by a bottom wall, and a run conductor opening between the pair of side walls and the bottom wall, the pair of side walls and bottom wall having a predefined width;

wherein the branch conductor portion includes at least one branch conductor opening having a lead-in with a rib on each side of the lead-in, and a hinge portion between the branch conductor opening and the connector body such that when force is applied by the crimping tool to the connector body, the hinge portion of the connector body compresses first to secure one or more branch conductors positioned in the at least one branch conductor opening to the connector body, and when additional force is applied by the crimping tool to the connector body the connector body is compressed around at least one run conductor positioned in the run conductor opening; and at least one insulating piercing member removably attached to or integrally formed into the run conductor portion, the at least one insulating piercing member having an elongated body extending substantially along the width of at least one of the pair of side walls or the bottom wall.

2. The compression connector according to claim 1, further comprising a conductor retainer movably attached to one of the pair of side walls of the run conductor portion.

3. The compression connector according to claim 2, wherein the conductor retainer is movably attached to one of the pair of side walls by a living hinge.

4. The compression connector according to claim 1, wherein the at least one insulation piercing member is removably attached to at least one of the pair of side walls and extends into the run conductor opening.

5. The compression connector according to claim 1, wherein the at least one insulation piercing member is removably attached to the bottom wall and extends into the run conductor opening.

6. The compression connector according to claim 1, further comprising an adapter removably attached to the connector body within the conductor opening.

7. The compression connector according to claim 6, wherein the adapter has an inner arcuate surface.

8. The compression connector according to claim 7, wherein the adapter includes at least one insulation piercing member extending from the arcuate surface of the adapter.

9. The compression connector according to claim 1, wherein the run conductor portion includes a track and the at least one insulating piercing member includes a rail used to removably attached the at least one insulating piercing member to the run conductor portion.

10. An electrical compression connector for connecting a plurality of conductors, the compression connector comprising:

a connector body of compressible material adapted to be inserted into a crimping tool having two opposed curved die surfaces for the compression of the connector body, the connector body having a run conductor portion and a branch conductor portion;

wherein the run conductor portion includes a pair of side walls joined by a bottom wall, and a run conductor opening between the pair of side walls and the bottom wall, and wherein the pair of side walls and bottom wall have a predefined width; and wherein the branch conductor portion includes at least one branch conductor opening having a lead-in with a rib on each side of the lead-in, and a hinge portion between the branch conductor opening and the connector body such that when force is applied by the crimping tool to the connector body, the hinge portion of the connector body compresses first to secure one or more branch conductors positioned in the at least one branch conductor opening to the connector body, and when additional force is applied by the crimping tool to the connector body the connector body is compressed around at least one run conductor positioned in the run conductor opening; and at least one insulating piercing member removably attached to or integrally formed into the pair of side walls or the bottom wall of the run conductor portion, the at least one insulating piercing member having an elongated body extending substantially along the width of at least one of the pair of side walls or the bottom wall.

11. The compression connector according to claim 10, further comprising a conductor retainer movably attached to one of the pair of side walls of the run conductor portion.

12. The compression connector according to claim 11, wherein the conductor retainer is movably attached to one of the pair of side walls by a living hinge.

13. The compression connector according to claim 10, wherein the at least one insulation piercing member is removably attached to at least one of the pair of side walls and extends into the run conductor opening.

14. The compression connector according to claim 10, wherein the at least one insulation piercing member is removably attached to the bottom wall and extends into the run conductor opening.

15. The compression connector according to claim 10, further comprising an adapter removably attached to the connector body within the conductor opening.

16. The compression connector according to claim 15, wherein the adapter has an inner arcuate surface.

17. The compression connector according to claim 16, wherein the adapter includes at least one insulation piercing member extending from the arcuate surface of the adapter.

18. The compression connector according to claim 10, wherein the run conductor portion includes a track and the at least one insulating piercing member includes a rail used to removably attached the at least one insulating piercing member to the run conductor portion.

19. An electrical compression connector for connecting a plurality of conductors, the compression connector comprising:

a connector body of compressible material adapted to be inserted into a crimping tool having two opposed curved die surfaces for the compression of the connector body, the connector body having a run conductor portion and a branch conductor portion;

wherein the run conductor portion includes a pair of side walls joined by a bottom wall, and a run conductor opening between the pair of side walls and the bottom wall, wherein the pair of side walls and bottom wall have a predefined width, and wherein the branch conductor portion includes at least one branch conductor opening; and at least one insulating piercing member removably attached to or integrally formed into the connector body, the at least one insulating piercing member having an elongated body extending substantially along a longitudinal axis of the run conductor portion the width of at least one of the pair of side walls or the bottom wall.

20. The compression connector according to claim 19, wherein the at least one insulation piercing member is removably attached to at least one of the pair of side walls and extends into the run conductor opening.

21. The compression connector according to claim 19, wherein the at least one insulation piercing member is removably attached to the bottom wall and extends into the run conductor opening.

22. The compression connector according to claim 19, further comprising a conductor retainer movably attached to one of the pair of side walls of the run conductor portion.

23. The compression connector according to claim 22, wherein the conductor retainer is movably attached to one of the pair of side walls by a living hinge.

24. The compression connector according to claim 19, further comprising an adapter removably attached to the connector body within the conductor opening.

25. The compression connector according to claim 24, wherein the adapter has an inner arcuate surface.

26. The compression connector according to claim 25, wherein the adapter includes at least one insulation piercing member extending from the arcuate surface of the adapter.

27. The compression connector according to claim 19, wherein the run conductor portion includes a track and the at least one insulating piercing member includes a rail used to removably attached the at least one insulating piercing member to the run conductor portion.

* * * * *